United States Patent [19]

Briscoe et al.

[11] Patent Number: 4,999,977

[45] Date of Patent: Mar. 19, 1991

[54] AUTOMATIC BAG FILLER

[76] Inventors: Jack R. Briscoe, 1682 Sanborn Rd.; James R. Briscoe, 1064 Sanborn Rd., both of Yuba City, Calif. 95991

[21] Appl. No.: 478,121

[22] Filed: Jan. 29, 1990

[51] Int. Cl.[5] ..... B65B 5/10; B65B 25/04; B65B 57/20

[52] U.S. Cl. ..... 53/501; 53/385.1; 53/500

[58] Field of Search ..... 53/501, 500, 502, 498, 53/251, 244, 469, 473, 385

[56] References Cited

U.S. PATENT DOCUMENTS

| | | | |
|---|---|---|---|
| 2,928,599 | 3/1960 | Ahlburg | 53/501 X |
| 3,018,592 | 1/1962 | Belk et al. | 53/501 |
| 3,492,779 | 2/1970 | Russell | 53/501 |
| 3,705,475 | 12/1972 | Riley | 53/501 X |
| 3,877,199 | 4/1975 | Lipes | 53/501 |
| 3,940,906 | 3/1976 | Leckband et al. | 53/501 X |
| 4,177,621 | 12/1979 | Powell, Jr. | 53/502 X |
| 4,253,292 | 3/1981 | Lipes | 53/506 X |
| 4,265,072 | 5/1981 | Egli | 53/501 |
| 4,619,104 | 10/1986 | Germunson | 53/159 |

*Primary Examiner*—James F. Coan
*Attorney, Agent, or Firm*—Lothrop & West

[57] ABSTRACT

Automatic bag filler for packaging predetermined numbers of spheroidal or ellipsoidal articles presorted to have substantially the same size and weight. From a bulk product receiving station the articles are conveyed through a singulating zone, thence through a counting station where the articles, in single file, are counted and carried to an inclined chute leading to a product bagging station. The counting mechanism halts the conveyor temporarily just as the last of the predetermined number of articles enters the top of the inclined chute. A blower acts in conjunction with suitably directed vanes to guide a flow of air toward the open end of the topmost one of a stack of bags thereby opening the topmost bag located at the bottom of the inclined chute for the reception of the counted articles. When the conveyor stops, the filled bag containing the predetermined number of articles is transferred to a bag closure station, thence to storage. In the meantime, operation of the conveyor is resumed, starting the next cycle.

8 Claims, 5 Drawing Sheets

FIG-5
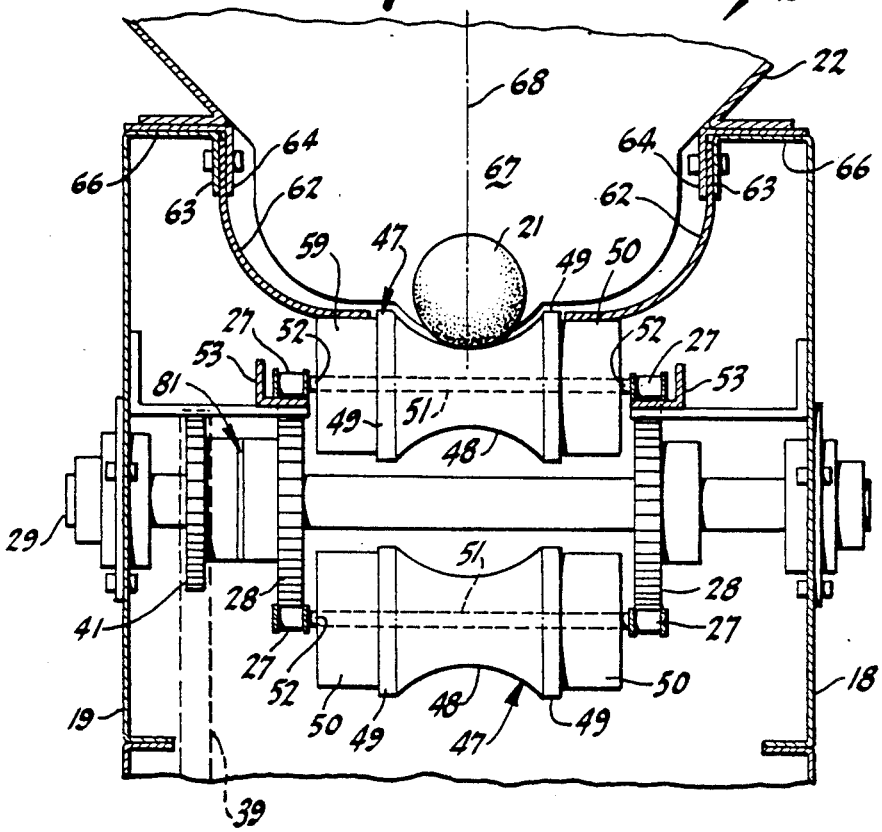
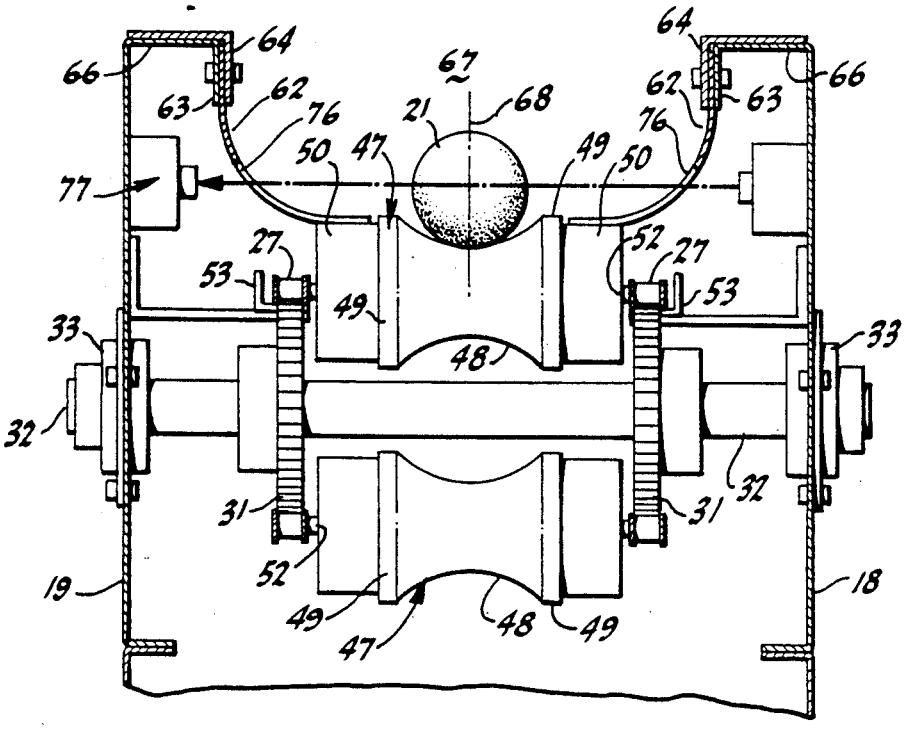
FIG-4

AUTOMATIC BAG FILLER

BACKGROUND OF THE INVENTION

1. Field of the Invention

The invention relates to an apparatus for packaging a predetermined quantity of spheroidal or ellipsoidal articles, such as oranges, plums, lemons, kiwis, onions and potatoes, presorted to be of substantially the same size and weight.

2. Prior Art

A search of the prior art disclosed eight U.S. patents relating to bag fillers, conveyors, counters, weighers, and the like, which receive, singularize, orient and package a plurality of individual pieces of fruit, eggs etc. The eight patents are as follows:

| | | | |
|---|---|---|---|
| Ahlburg | No. 2,928,599 | Powell, Jr. | No. 4,177,621 |
| Seaborn | No. 3,503,501 | Lipes | No. 4,253,292 |
| Lipes | No. 3,877,199 | Egli | No. 4,265,072 |
| Leckband et al. | No. 3,940,906 | Germunson | No. 4,619,104 |

while the foregoing patents illustrate various features of general interest, applicants believe that taken either distributively or in combination they neither anticipate applicants' device nor do they render applicants' device obvious.

SUMMARY OF THE INVENTION

Mounted on one end of a compact, elongated frame is an article-receiving hopper. By gravity, the articles descend from the hopper onto the upper run of a longitudinally oriented conveyor mounted on the frame. While transporting the articles toward a packager located on the other end of the frame, the conveyor singulates the articles so that they can be accurately tallied as they pass an article counter. The article counter is of conventional construction and is adjustable to pass a predetermined number of articles to the packager and then temporarily disable the conveyor, allowing the filled package to be removed before the cycle is resumed.

BRIEF DESCRIPTION OF THE DRAWING FIGURES

FIG. 4 is a fragmentary, transverse, sectional view, to an enlarged scale, taken on the plane indicated by the line 4—4 in FIG. 3;

FIG. 5 is a sectional view taken on the line 5—5 of FIG. 3;

DETAILED DESCRIPTION OF THE PREFERRED EMBODIMENT

Figure 1:
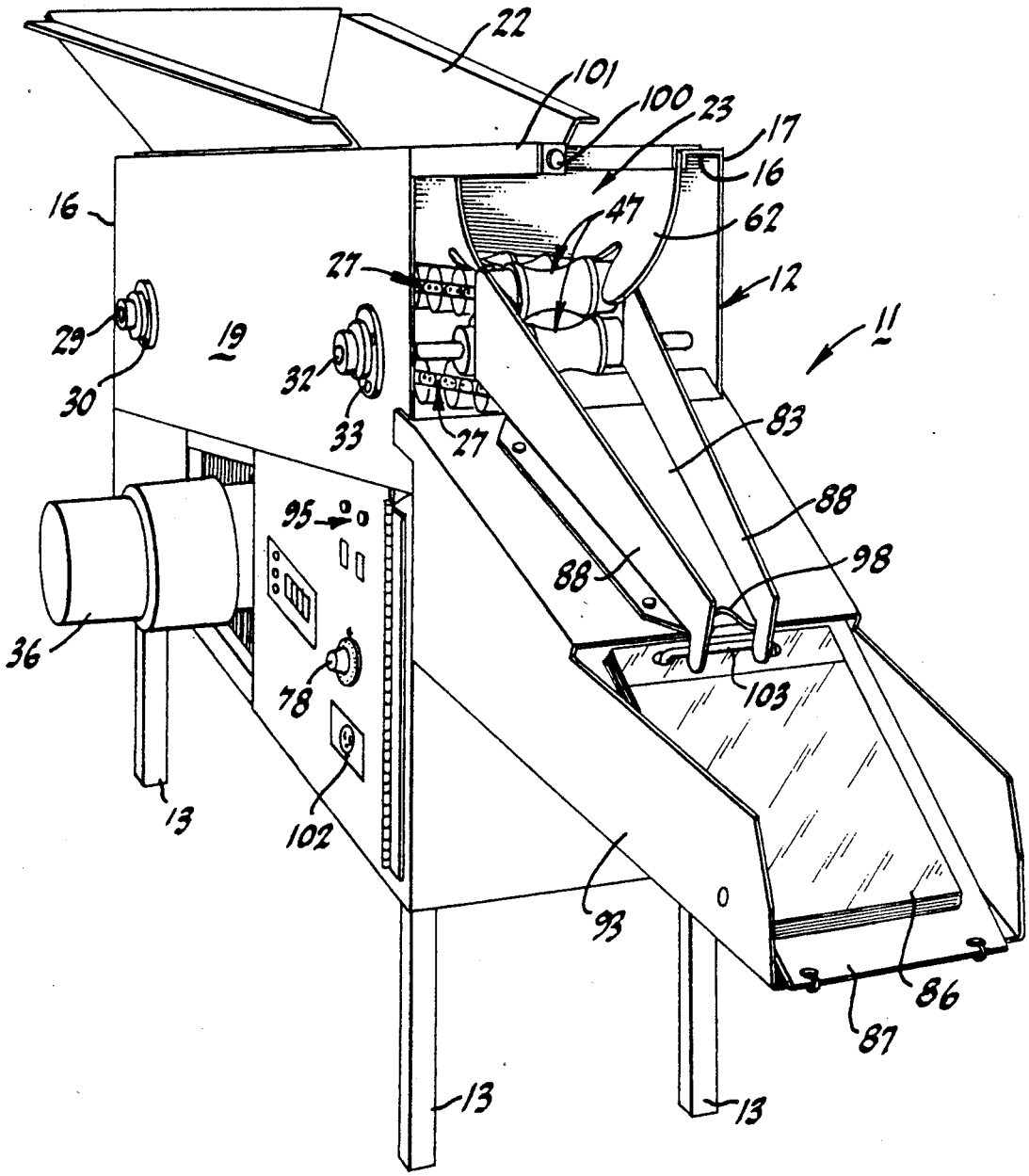
FIG. 1 is a perspective view taken from the packaging end of the automatic bag filler.

While the automatic bag filler of the invention is susceptible of various different embodiments, depending upon the environment and requirements of use, the herein shown and described preferred embodiment has been tested with good results.

The successful operation of the device stems from a careful presorting procedure in which spheroidal or ellipsoidal articles of substantially identical size, shape and weight are segregated into respective groups. By so doing, articles such as fruits and vegetables can be packaged, as in bags, by number rather than by weight, as such.

In other words, if generally spherical or almost spherical articles, including such fruits as citrus, kiwis and some stone fruits, as well as vegetables, such as onions and potatoes, are first classified into a preselected size and weight group having relatively small variations in size and weight, packaging can be effected by the number of articles rather than by total weight as determined by a weight-measuring scale.

The principal advantage of such a procedure is that numbers can ordinarily be determined more quickly than weight. Thus, by applying a safety factor ensuring that package net weight under all circumstances will be equal to or exceed the net weight indicated on the package, economics in packaging can be effected without prejudice to the purchaser.

The following description will take for granted that appropriate presorting has been effected so that the packages will meet all Federal and State labeling requirements.

The automatic bag filler of the invention is designated by the reference numeral 11, and broadly comprehends an elongated frame 12 supported on suitable ground-engaging legs 13.

The apparatus can be very compact in size owing to the efficient singularization achieved by the article-conveying system, generally identified by the numeral 14.

It has been determined, for example, that with a total apparatus length of only sixty five inches and a height (not counting leg height) of approximately twenty six inches, articles, such as presorted, spheroidal or ellipsoidal fruits and vegetables, can be bagged at a rate of about twenty one-pound bags per minute, or one every three seconds, a rate considerably superior to that attained by present day machines for packaging comparable fruits and vegetables.

The frame 12 extends longitudinally from a first end wall 16 to a second end wall 17 and transversely from one side wall 18 to an opposite, parallel side wall 19.

Although the opposite side walls 18 and 19 of the frame 12 adjacent the first, or bulk-article-receiving, end 20 of the frame are capable of receiving and handling a considerable quantity of articles 21, such as oranges, lemons or similar spheroidal or ellipsoidal fruits or vegetables, capacity is increased by a hopper 22 mounted on the first, or bulk-article-receiving end 20 of the frame 12.

The addition of the hopper 22 is not critical to the operation of the machine; but it serves as an equalizing reservoir of articles which may be received in quantities which vary considerably from the capacity of the article conveying system 14.

The article conveying system 14 not only serves to transport the items toward the second, or packaging, end 23 of the frame 12; but it also serves to singularize, or position the articles in single file, before the articles reach the second end 23 of the frame 12.

Singulation of the articles is accomplished by operation of an elongated conveyor 24 located between the side walls 18 and 19 and extending from a first, lower end 25 to a second, higher, or upper end 26. The slope, or inclination, of the conveyor is a variable; and plays an important part in the singulation procedure, being dependent upon the size and geometry of the particular article undergoing transport and singulation.

Structurally, the conveyor 24 comprises a pair of endless, driven chains 27 trained at the lower ends about a respective pair of opposite lower sprockets 28 mounted on a lower shaft 29, or tail shaft, journaled at opposite ends in bearings 30 mounted on the side walls 18 and 19. The upper ends of the driven chains 27 are trained about a pair of upper sprockets 31 mounted on an upper shaft 32, or head shaft, journaled at opposite ends in bearings 33 secured to the side walls 18 and 19.

Driving the conveyor 24 is an electric motor 36 having a shaft 37 provided with a drive sprocket 38 connected by an endless drive chain 39 to a driven sprocket 41 on the lower shaft 29, or tail shaft.

Figure 3:
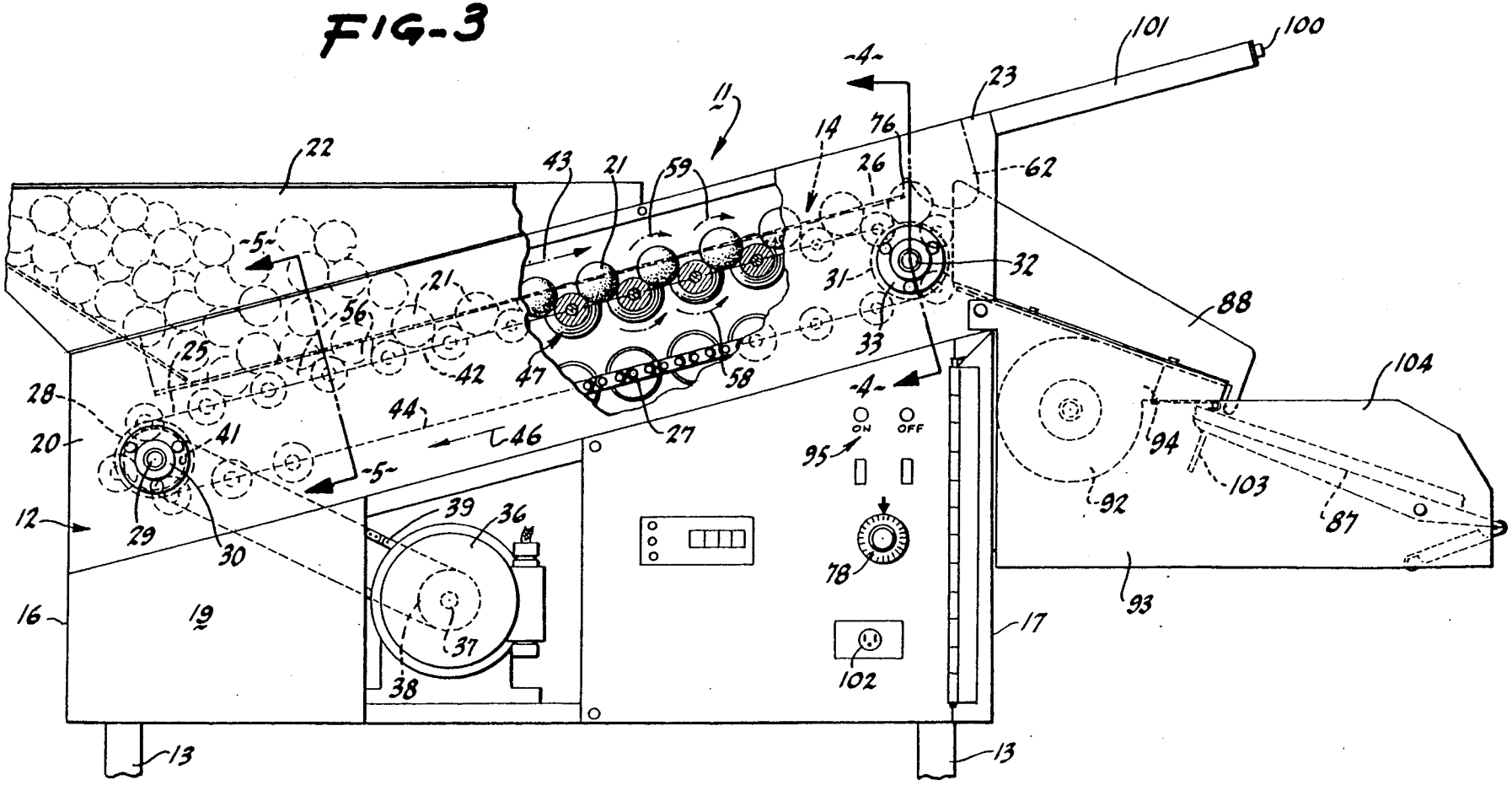
FIG. 3 is a fragmentary side elevational view with portions broken away to disclose certain structural details and illustrating the article flow path.
Figure 6:
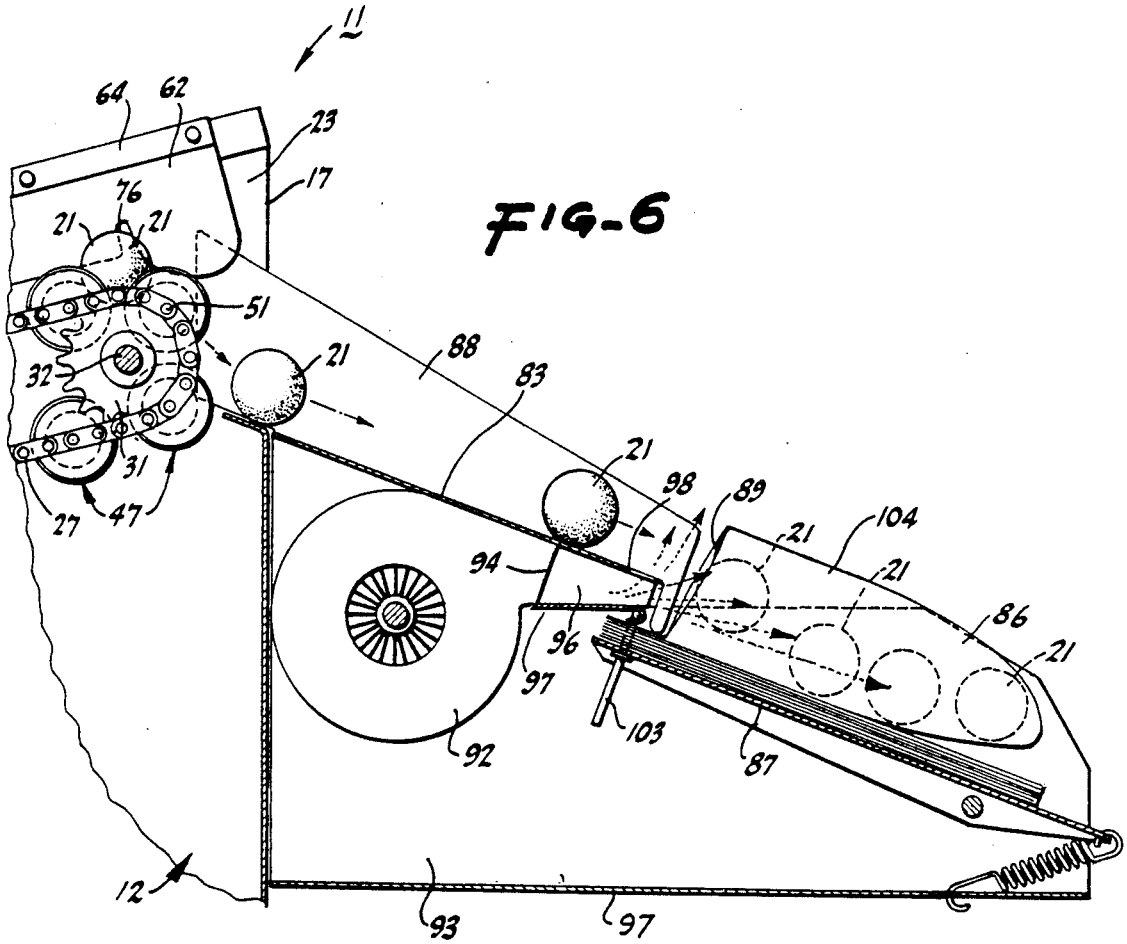
FIG. 6 is a sectional view taken on the line 6—6 of FIG. 2.
Figure 7:
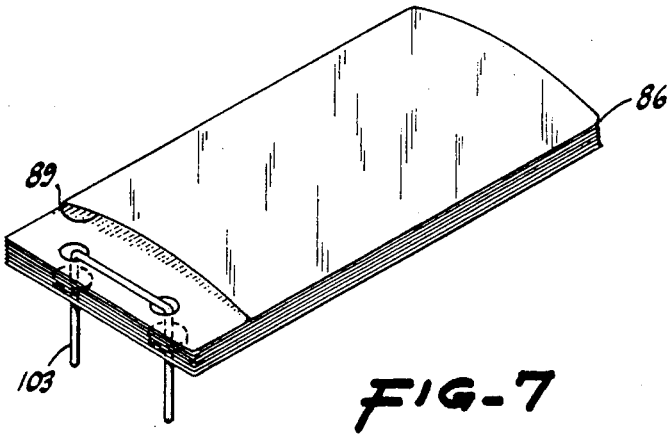
FIG. 7 is a perspective view of the bag packet.

During operation of the device, the motor 36 drives the endless chains 27 in a direction such that the upper run 42 of the chains 27 move from the lower end 25 of the conveyor 24 toward the upper end 26 thereof, as indicated by the directional arrow 43 in FIG. 3. The lower run 44 of the chains 27 return in the direction of the arrow 46.

Serving to transport and singulate the individual articles 21 as they move on the conveyor 24 from the first, lower end 25 toward the second, upper end 26 thereof, is a plurality of rollers 47 formed of a hard, smooth-surfaced material.

As best appears in FIGS. 4 and 5, the rollers 47 include an hour-glass shaped central portion 48 spanning a pair of flanges 49 and, outboard of the flanges 49, a pair of drums 50. The rollers 47 are freely rotatable on respective cross-shafts 51 journaled at opposite ends in bushings 52 inserted at suitable intervals in the endless pair of parallel chains 27. Each of the upper runs 42 of the chains 27 is supported on a respective L-shaped-in-section track 53.

With the conveyor 14 in operation, the upper runs 42 of the endless chains 27 are disposed on the pair of tracks 53, commencing as the chains 27 round the lower sprockets 28 and continuing forwardly and upwardly in the direction 43, in a straight line, until the chains 27 begin to round the upper sprockets 31 and start the return, or lower run, in the direction 46.

Partaking of the endless route followed by the chains 27, the plurality of rollers 47 begin the forward and upward run underneath the articles 21 located in the hopper 22 (see FIG. 3).

Figure 2:
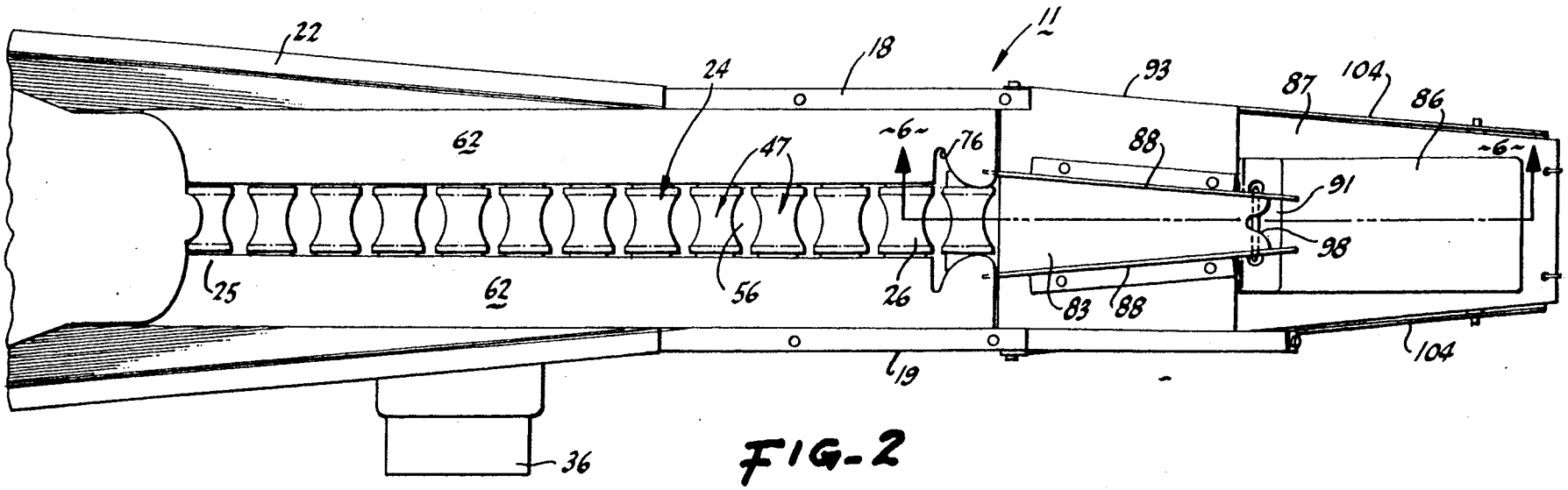
FIG. 2 is a fragmentary top plan view.
Figure 8:
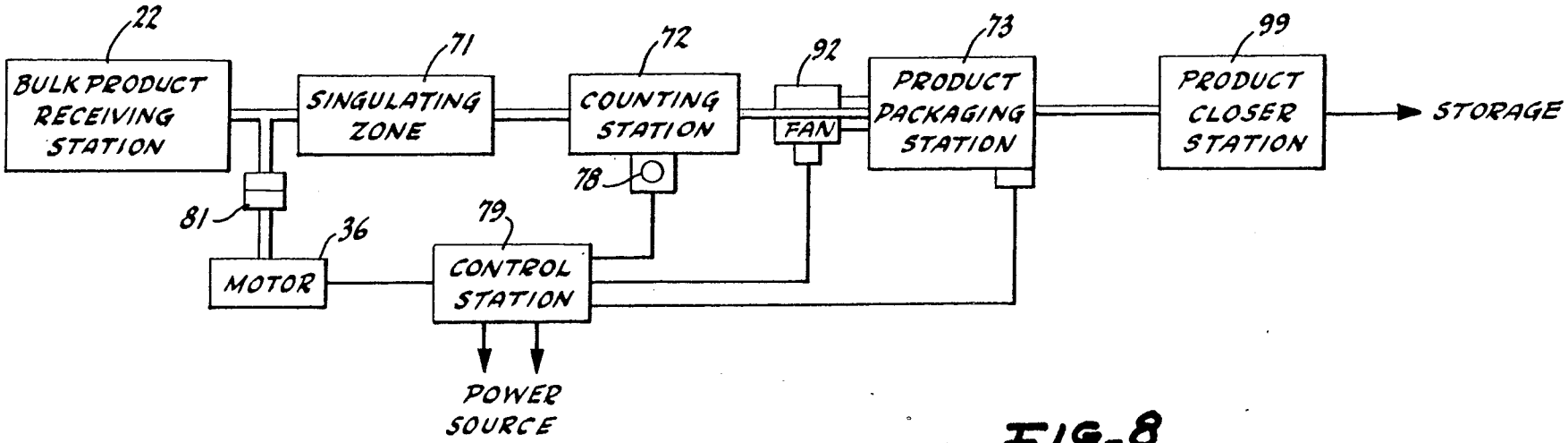
FIG. 8 is a diagram showing the relationship of the major functional components of the apparatus.

In plan, the rollers provide an endless succession of cradles 56, or pockets, each being formed by two adjacent rollers; more particularly by the two adjacent central, hour-glass shaped portions 48 of the two adjacent rollers (see FIG. 2).

As the rollers 47 and attendant cradles 56 pass under the articles in the hopper, gravity urges the articles downwardly toward the moving cradles; and at least one of the articles tends to become lodged in each cradle and is carried thereby in the forward and upward direction 43. Since the geometry of the rollers 47 and the spacing between the rollers is selected to afford a cradle of optimum size and shape for the particular article being handled, an article once lodged in a cradle tends to remain therein through the entire upper run 42.

In many cases, however, a single article is imperfectly lodged in a respective cradle; or two articles have become oriented in such a way that both are partially lodged in a single cradle. In either case, the accuracy of the singulating process is compromised.

We have therefore developed a mechanism for assuring that singulation is quickly and accurately effected.

This mechanism involves rotating the rollers 47 in a direction such that the forward, or leading, transverse element of each roller moves upwardly, then rearwardly, whereas the after, or trailing, transverse element of each roller moves downwardly, then forwardly. In short, each of the rollers 47, as viewed in FIG. 3, rotates in a counterclockwise direction 58 throughout the upper run 42 of the chains 27 and attendant rollers 47.

Thus, as the rollers 47 traverse the upper run 42, the forward boundary surface of each of the cradles 56 (i.e. the rear upper quadrant surface of the forward roller) moves in a rearward and downward direction. Simultaneously, the rear, or after, boundary surface of each of the cradles 56 (i.e. the forward upper quadrant surface of the after roller) moves in a rearward and upward direction.

As a consequence, any article or articles lodged in the individual cradles are subjected to a pair of rotational, frictional forces tending to rotate the lodged article or articles in a clockwise direction 59, as viewed in FIG. 3.

The effect of this rotational motion of the articles disposed in the cradles is to dislodge from the cradle any articles sharing or trying to enter the cradle which are not as perfectly juxtaposed in the cradle as the initial occupant.

Thus, any extraneous articles superposed on cradles already occupied by a single, well-fitting article are excluded. Rotating, well-fitting articles, upon coming into contact with a less well-fitting article cause the latter to counter-rotate and to move aside and to roll backwardly and downwardly under the influence of gravity, the conveyor being inclined, as appears most clearly in FIG. 3.

The angle of inclination of the conveyor, as previously noted, is one of the important variables, of the system. Other important variables are the geometry of the rollers, the conveyor speed and the nature of the articles being handled. All of these parameters are readily ascertainable by experimentation.

Although rotation of the rollers 47 can be effected in a variety of ways, we prefer, in the interest of reliability, simplicity and economy of installation and upkeep, to utilize the friction between the rolling surfaces of the roller drums 50 and the downward urgency of the inner edge portions 61 of a pair of arcuate belt flaps 62. Conveniently, the outer edge portion 63 of the belt flaps 62 are secured in respective clamps 64 located at intervals along overhangs 66, or ledges, extending inwardly from the tops of the side walls 18 and 19.

The belt flaps 62 form, in transverse section, as appears most clearly in FIGS. 4 and 5, a U-shaped trough 67. The belt flaps 62 serve a dual purpose in that the drag or friction between the inner edges 61 of the flaps 62 in pressing against the rollers 47 as they are carried along the upper run 42, cause the rollers to rotate in the desired counter-clockwise direction 58 as viewed in FIG. 3; and the belt-flaps 62 also provide the trough 67, down which the non-singulated articles can roll until an empty cradle 56, or pocket, is encountered. The arcuate belt flap walls 62 of the trough 67 afford sufficient inclination toward the median, vertical, longitudinal plane 68 of the rollers 47 so that the dislodged articles in rolling backwardly down the trough are constantly urged toward the advancing roller cradles 56 until an empty cradle is found.

The combined effect of the various components shown and described is that as the rollers pass along the upper run 42 of the conveyor, the articles disposed within the hopper 22, or bulk product receiving station, are quickly placed in single file in respective cradles as they advance through the singulating zone 71 and enter the counting station 72 en route to the product packaging station 73.

Adjacent the upper end of the trough 67 the opposite lateral sides of the belt flaps have a respective pair of apertures 76 formed therein for the passage of a transverse beam originated and received by the respective components of an article counter 77, such as a conventional electric-eye. In well-known fashion, the counter 77 includes an infra-red beam generator on one lateral side, such as on the inside surface of the side wall 18 and a beam receptor on the other lateral side, such as on the side wall 19 (see FIG. 4). The beam is at a location such that as each singulated article passes through the counting station 72, the beam is interrupted and is tallied on a register. The register is adjustable so that any predetermined number of articles can be entered; and in the present case, can be set by turning a knob 78 on the side wall 19, for example. When the pre-selected number of articles has traversed the beam, the counter has been programmed by setting the knob 78 to send a signal to a control station 79 ordering that the motor 36 be deactivated and that a motor brake 81 be activated, halting further movement of the conveyor virtually instantaneously.

The timing of the counter station signal, the controller signal and the motor braking is arranged so that at the instant the conveyor 14 comes to a complete stop, the cradle 56 in which the last of the predetermined number of counted articles is lodged, has rounded the forward upper portion of the sprockets 31 far enough so that the lodged article is discharged from the cradle into a forwardly and downwardly inclined chute 83 leading to the product packaging station 73. In this way, the full count is deposited at the packaging station.

Although various types of packages can be utilized, the present embodiment use plastic bags 86. A stack of the bags 86 is supported on a shelf 87 located at the bottom of the chute 83 so that as the individual articles 21 are discharged from the respective cradles and roll down the chute, and are centered by a pair of converging guide walls 88, the articles roll forwardly and under their own momentum enter the topmost one of the bags 86 on the stack, the mouth 89 of the bag having previously been opened and kept open by a flow of air emerging from a transversely enlarged nozzle 91.

The flow of air is provided by a blower 92, or fan, located under the chute 83 and centered between an opposite pair of panels 93.

The mouth 94 of the blower 92 merges into a transversely elongated channel, 96, or passageway, bounded on the top by the chute 83, on the lateral edges by the opposite panels 93 and on the bottom by a floor plate 97.

An important feature of the air nozzle is a generally triangular notch 98 located centrally on the forward edge of the chute 83, as appears most clearly in FIGS. 1 and 2. The notch 98 serves to emit air forwardly and upwardly in a central location, thereby maintaining the mouth 89 of the topmost one of the bags 86 in maximum open position, and facilitating the entry of the individual articles emerging centrally from the bottom of the chute 83.

As the last of the predetermined number of articles has rolled into the topmost bag, the blower continues it operation even though the conveyor has temporarily stopped, as explained above. Thus, when the topmost, filled bag is removed from the packaging station 73 for transfer to a package closure station 99 and thence to storage, or other disposition, the mouth 89 of the newly exposed, topmost bag 86 is immediately opened, preparatory to receiving the next series of articles in the next cycle of operation.

The cycle is resumed by re-setting, or reactivating the motor 36, drive train and conveyor 24. Although resumption of the cycle of operation can be effectuated in several ways, the present embodiment utilizes a re-set button 100 on the forward end of a stalk 101 projecting forwardly from the end wall 17, readily accessible to an operator (not shown) located adjacent the packaging station 73. This position of the button 100 conveniently enables the operator to reactivate the system immediately after the filled bag is removed and transferred to the product packaging station 99, merely by reaching a few inches with the left hand (as in FIG. 3) and pressing the button 100.

As will be appreciated, removal of the filled bag and resumption of the bag filling cycle could also be effected automatically by providing equipment capable of performing these functions, such equipment being outside the scope of the present disclosure.

Although not shown in detail, the embodiment of the bag filler disclosed herein includes conventional components such as a socket 102 for connection to a power source, as well as a main power on-off switch 95, individual blower and motor switches, if desired, along with various indicator lights and gauges and connecting wiring.

In initial operation, a stack of plastic bags on the usual wicket 103 is inserted on the bag shelf 87 between the opposite side walls 104 of the bag shelf 87 and the main power switch 95 is turned on, along with the motor and blower switches.

A supply of the presorted articles 21 is then deposited in the hopper 22, either in batches or by a continuous flow from a conveyor. The conveyor-singulator system 14 performs its task of carrying away the articles from the hopper area and positioning the articles in single file in the respective cradles 56 formed by the adjacent hour-glass shaped rollers. As the articles move ahead along their forward and upward path they successively interrupt the beam of a counter, such as an "electric eye" and are thereby tallied.

The articles spill out of the respective cradles as the rollers round the bend at the end of the upper run of the conveyor and roll down an inclined chute and through the open mouth of the topmost bag of the stack, the mouth being opened and kept open by a flow of air from a blower underneath the chute.

When a predetermined number of articles has been counted and deposited in the bag by gravity, the conveyor stops, allowing the filled bag to be removed for transfer to a bag closure station. Resumption of the cycle is effected by suitable activation of a re-set switch.

We claim:

1. Automatic bag filler for packaging predetermined numbers of spheroidal or ellipsoidal articles having substantially the same size and weight comprising:

a. an elongated frame extending from a first, bulk-article-receiving end to a second, packaged-article-discharge end;

b. conveyor means mounted on said frame for positioning the bulk articles in single file and moving the singulated articles toward said second end;

said conveyor means including a first pair of sprockets journaled on said frame adjacent said first end thereof and a second pair of sprockets journaled on said frame adjacent said second end thereof; a pair of endless chains trained around respective ones of said first and said second pairs of sprockets, said pair of chains being laterally spaced apart and movable in parallel relation with the upper runs extending from said first end of said frame to said second end thereof; a plurality of hour-glass contoured rollers rotatably mounted on said pair of chains, said rollers being longitudinally spaced apart to form a plurality of article-holding cradles; means for driving at least one of said pairs of sprockets so that on the upper runs of said chains said rollers are moved from said first end toward said second end; a pair of chain-supporting tracks mounted longitudinally on said frame and underlying said chains along the upper runs thereof; and means mounted on said frame for rotating said rollers while said rollers are carried by said chains along the length of said tracks;

c. means for counting the singulated articles;

d. means interconnecting said counting means and said conveyor means for disabling said conveyor means when a predetermined number of articles reach said second end; and, e. means mounted on said second end for packaging said predetermined number of articles.

2. Automatic bag filler as in claim 1 in which said roller rotating means includes a pair of article centering U-shaped in section side walls mounted on said frame and extending from said first end to said second end, the bottom edges of said side walls being in frictional rubbing contact with the end portions of said rollers so that as said rollers are moved from said first end toward said second end, the frictional drag exerted on said rollers causes said rollers to rotate.

3. Automatic bag filler as in claim 1 in which said roller rotating means is effective to rotate said rollers in a direction in which the leading element of the roller moves upwardly and the trailing element of the roller moves downwardly whereby an article located in a given one of said cradles is frictionally urged to rotate in a forwardly rolling direction and to deflect other articles from entering said given one of said cradles.

4. Automatic bag filler as in claim 3 in which said first pair of sprockets is lower in elevation than said second pair of sprockets so that the upper runs of said chains, said chain-supporting tracks and the adjacent ones of said rollers move forwardly and upwardly along a path having a predetermined upward slope, said slope being sufficient gravitally to urge movement in a rearward and downward direction of an article deflected away from said given one of said cradles and toward a following one of said cradles.

5. Automatic bag filler as in claim 4 in which said counting means includes an electric eye mounted on said second end of said frame in a location such that the beam is interrupted by the passage therethrough of the singulated articles.

6. Automatic bag filler as in claim 4 in which said packaging means comprises a chute extending forwardly and downwardly to guide the singulated articles dislodged from the respective cradles as the associated rollers pass around the ends of said second pair of sprockets; means for stacking a plurality of bags so that the mouth faces toward said chute; a nozzle below said chute and directed toward the mouth of the bags; and a blower connected to said nozzle for opening the mouth of the topmost bag by air flow for the reception of the articles.

7. Automatic bag filler as in claim 6 further including means for removing the filled bag; and means for reactivating said conveyor means to initiate the next operational cycle.

8. Automatic bag filler as in claim 7 including an electric motor mounted on said frame for driving said conveyor means and said blower; and switch means for controlling the on and off operation of said motor.

* * * * *